US008150703B2

(12) United States Patent
Cox et al.

(10) Patent No.: US 8,150,703 B2
(45) **Date of Patent: *Apr. 3, 2012**

(54) METHOD AND APPARATUS FOR REDUCING ACCESS DELAY IN DISCONTINUOUS TRANSMISSION PACKET TELEPHONY SYSTEMS

(75) Inventors: Richard Vandervoort Cox, New Providence, NJ (US); David A. Kapilow, Berkeley Heights, NJ (US)

(73) Assignee: AT&T Intellectual Property II, L.P., Atlanta, GA (US)

( * ) Notice: Subject to any disclaimer, the term of this patent is extended or adjusted under 35 U.S.C. 154(b) by 84 days.

This patent is subject to a terminal disclaimer.

(21) Appl. No.: 12/538,911

(22) Filed: Aug. 11, 2009

(65) Prior Publication Data

US 2009/0299758 A1 Dec. 3, 2009

Related U.S. Application Data

(63) Continuation of application No. 11/675,278, filed on Feb. 15, 2007, now Pat. No. 7,584,106, which is a continuation of application No. 11/190,434, filed on Jul. 27, 2005, now Pat. No. 7,197,464, which is a continuation of application No. 09/769,119, filed on Jan. 25, 2001, now Pat. No. 7,016,850.

(60) Provisional application No. 60/178,094, filed on Jan. 26, 2000.

(51) Int. Cl.
*G10L 21/04* (2006.01)
*G10L 21/00* (2006.01)

(52) U.S. Cl. ..... 704/503; 704/201; 704/211

(58) Field of Classification Search ..... None
See application file for complete search history.

(56) References Cited

U.S. PATENT DOCUMENTS

| | | | |
|---|---|---|---|
| 3,104,284 | A | 9/1963 | French et al. |
| 5,216,744 | A | 6/1993 | Alleyne et al. |
| 5,386,493 | A | 1/1995 | Degen et al. |
| 5,555,447 | A | 9/1996 | Kotzin et al. |
| 5,699,404 | A | 12/1997 | Satyamurti et al. |
| 5,706,393 | A | 1/1998 | Ehara |
| 5,796,719 | A | 8/1998 | Peris et al. |
| 5,806,023 | A | 9/1998 | Satyamurti |
| 6,356,545 | B1 | 3/2002 | Vargo et al. |
| 6,484,137 | B1 | 11/2002 | Taniguchi et al. |

OTHER PUBLICATIONS

"Real-time implementation of time domain harmonic scaling of speech for rate modification and coding", R. Cox et al., Acoustics, Speech and Signal Processing, IEEE Transactions, vol. 31, Issue 1, Feb. 1983, pp. 258-272.

"High quality time-scale modification for speech", S. Roucos et al., Acoustics, Speech and Signal Processing, IEEE International Conference on ICASSP '85, vol. 10, Apr. 1985, pp. 493-496.

*Primary Examiner* — Brian Albertalli

(57) ABSTRACT

Systems are disclosed for operating a communications network. The system includes a module to buffer frames of a signal, and a module to determine an access delay. The system also includes a module to compress a portion of the signal based on the access delay by removing a first portion of a frame of the signal and generating an overlap-added segment from a first segment and a second segment of the frame. In another embodiment, the system includes a module to buffer frames of a signal, a module to establish a communication channel with a handset, and a module to determine an access delay. The system also includes a module to compress a portion of the signal based on the access delay by removing a first portion of a frame of the signal and generating an overlap-added segment from a first segment and a second segment of the frame.

20 Claims, 8 Drawing Sheets

METHOD AND APPARATUS FOR REDUCING ACCESS DELAY IN DISCONTINUOUS TRANSMISSION PACKET TELEPHONY SYSTEMS

RELATED APPLICATIONS

The present application is a continuation of U.S. patent application Ser. No. 11/675,278, filed Feb. 15, 2007, which is a continuation of U.S. patent application Ser. No. 11/190,434, filed Jul. 27, 2005, now U.S. Pat. No. 7,197,464, which is a continuation of U.S. patent application Ser. No. 09/769,119, filed Jan. 25, 2001, now U.S. Pat. No. 7,016,850, which claims priority to U.S. Provisional Application No. 60/178,094, filed Jan. 26, 2000.

TECHNICAL FIELD

The present disclosure is related to methods and devices for use in cell phones and other communication systems that use statistical multiplexing wherein channels are dynamically allocated to carry each talkspurt. It is particularly directed to methods and devices for mitigating the effects of access delay in such communication systems.

BACKGROUND

In certain packet telephony systems, a terminal only transmits when voice activity is present. Such discontinuous transmission (DTX) packet telephony systems allow for greater system capacity, as compared with systems in which a channel is allocated to a transmitting terminal for the duration of the call, or session.

With reference to FIG. 1, in DTX systems, at the start of each talkspurt, the transmitting device 102, typically a wireless handset, requests a transmission channel from the base station 104. The base station 104, which uses statistical multiplexing for allocating channels, establishes a path via a network 106 and/or intermediate switches 108 to connect to the remote receiving device 110, which may be another handset, conventional land-line phone, or the like.

FIG. 2 presents a block diagram of the principal functions of the transmitting device 102 and the base station 104 in a DTX system. A speaker=s voice is received by an audio input port (AIP) 122 where the voice signal is digitally sampled at some frequency fs, typically fs=8 kHz. The sampled signal is usually divided into frames of length 10 msec or so (i.e., 80 samples) prior to further processing. The frames are input to a voice activity detector (VAD) 124 and a speech encoder 126. As is known to those skilled in the art, in some devices, the VAD 124 is integrated into the speech encoder 126, although this is not a requirement in prior art systems. In any event, the VAD 124 determines whether or not speech is present and, if so, sends an active signal to the handset=s control interface 128. The handset=s control interface 128 sends a traffic channel request over the control channel 130 to the traffic channel manager 132 resident in the base station 104. In response to the request, the traffic channel manager 132 eventually sends back a traffic channel grant to the handset=s control interface 128, using the control channel 130. Upon receiving the traffic channel grant, the handset=s control interface notifies the VAD 124, the speech encoder 126 and/or the handset=s bit-stream transmitter 134 that a traffic channel 136 has been allocated for transmitting voice data. When this happens, the speech encoder 126 encodes the speech frames and sends the encoded speech signal to the handset=s bit-stream transmitter 134 for transmission over the traffic channel 136 to the appropriate bit-stream receiver 138 associated with the base station 104. In some devices, the speech encoder 126 prepares frames for transmission and sends these to the bit-stream transmitter, whether or not there is voice information to be transmitted. In such case, the transmitter does not transmit until it receives a signal indicating that the traffic channel 136 is available.

In the above-described conventional system, there is delay between the time that frames emerge from the audio input port and the bit-stream transmitter 134 begins to transmit voice data. The overall delay includes a first delay associated with the time that it takes the VAD to detect that voice activity is present and notify the handset=s control interface prior to the traffic channel request, the AVAD delay@, and a second delay associated, with the time between the traffic channel request and the traffic channel grant, the Achannel access delay@. The length of the VAD delay is fixed for a given handset, and depends on such things as the frame length being used. The length of the channel access delay, however, varies from talkspurt to talkspurt and depends on such factors as the system architecture and the system load. For example, in the wireless voice over EDGE (Enhanced Data for GSM Evolution) system, the channel access delay is approximately 60 msec, and possibly more. Conventionally, mitigating any type of access delay entails either a) buffering the voice bit-stream until permission is granted, and thereby retarding transmission by that amount of time, b) throwing away speech at the beginning of each utterance (Ai.e., A front-end clipping@) until permission is granted, or c) a combination of the two approaches. The buffering option introduces delay, which is detrimental to the dynamics of interactive conversations. Indeed, adding 120 msec of round trip delay just for access delay can break the overall delay budget for the system. The front-end clipping option often cuts off the initial consonant of each utterance, and thus hurts intelligibility. Finally, combining the two options such that less clipping occurs at the expense of delay is less than satisfactory because such an approach suffers from the disadvantages of both.

SUMMARY

The present disclosure is directed to a method and system for removing access delay during the beginning of each utterance as the talkspurt progresses. This is done by time-scale compressing, i.e., speeding up, the speech at the start of a talkspurt before it is passed to the speech coder. The speech is speeded up by buffering each talkspurt, estimating the speaker=s pitch period, and then deleting an integer number of pitch period=s worth of speech from the buffered talkspurt to produce a compressed talkspurt. The compressed talkspurt is then encoded and transmitted until the access delay has been fully mitigated, after which the incoming voice signal is passed through without further compression for the remainder of the talkspurt.

In one aspect of the present disclosure, the speech is speeded up by between 10-15%, so that a 60 msec delay is mitigated between the first 400-600 msec of a talkspurt.

In another embodiment, the system includes a processor, a module configured to control the processor to buffer frames of a signal, and a module configured to control the processor to determine an access delay of a channel request for the signal. The system also includes a module configured to control the processor to compress a portion of the signal based on the access delay by removing a first portion of a frame of the signal, and generating an overlap-added segment from a first segment of the frame located before the first portion and a second segment of the frame comprising an endmost portion of a terminal section of the frame.

BRIEF DESCRIPTION OF THE DRAWINGS

The present disclosure can better be understood through the attached figures in which.

DETAILED DESCRIPTION

Figure 1:
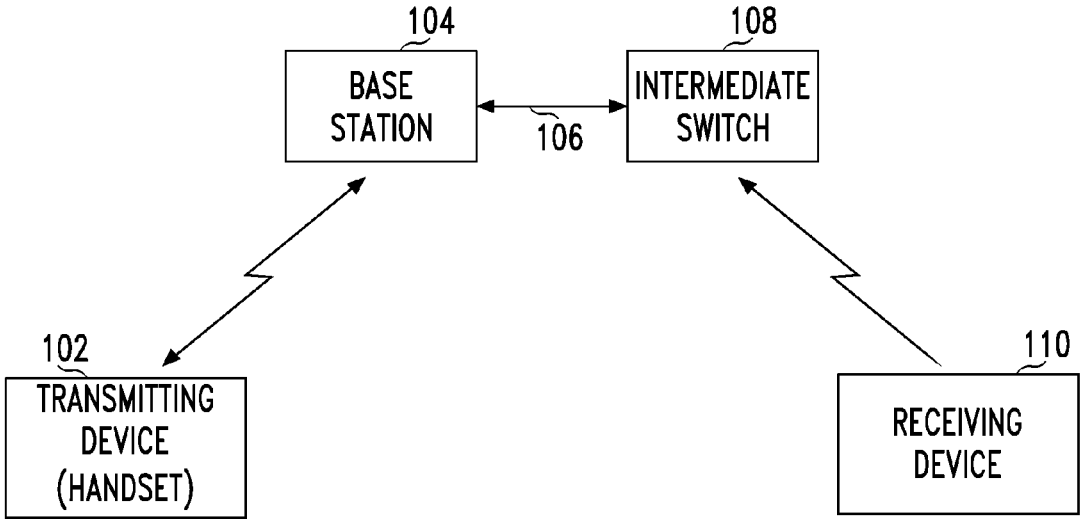
FIG. 1 PRIOR ART
FIG. 1 shows a conventional communication system.
Figure 2:
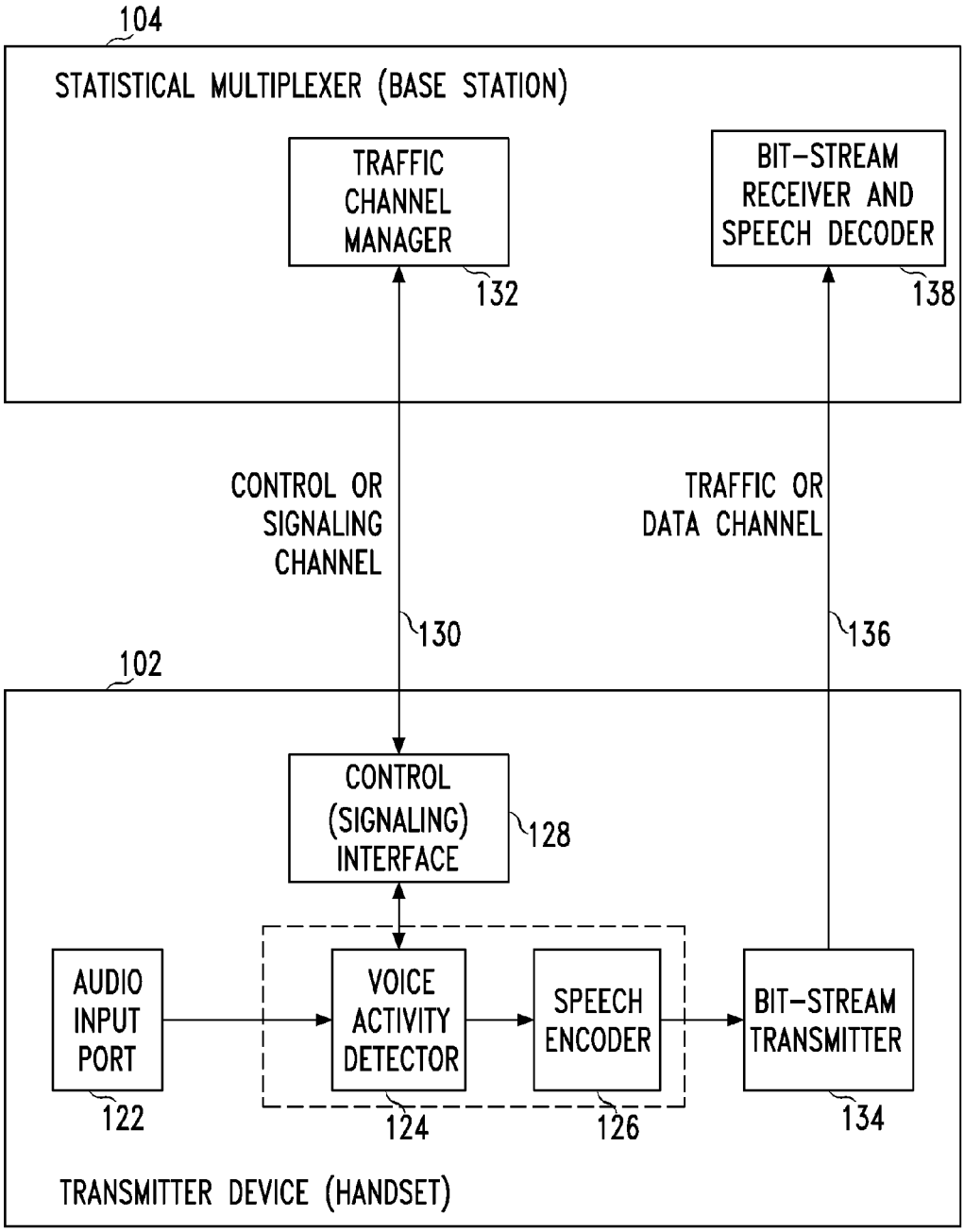
FIG. 2 PRIOR ART
FIG. 2 shows a functional block diagram of pertinent portions of a conventional transmitter.
Figure 3:
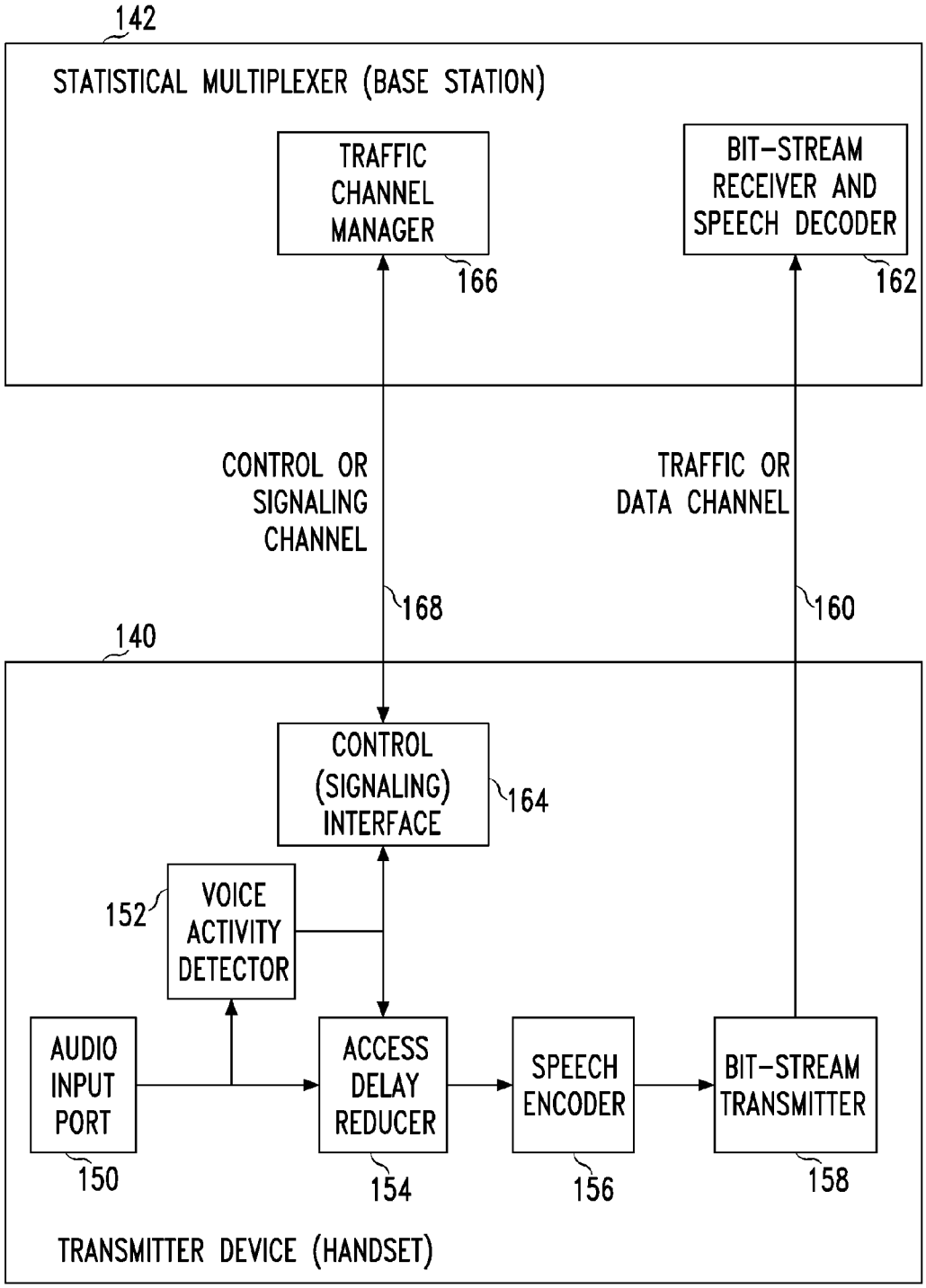
FIG. 3 shows a functional block diagram of pertinent portions of a communication device.

With reference to the communication device 140 and the base station 142 of FIG. 3, a speaker speaks into the AIP 150 which, in turn, outputs frames of speech. The frames of speech are input to both the Voice Activity Detector (VAD) 152 and the Access Delay Reducer (ADR) 154. The VAD makes a binary yes/no decision as to whether or not each input frame contains voice activity. If voice activity is detected, the speech frames are encoded by the speech encoder 156 and transmitted by the bit-stream transmitter 158 via the traffic channel 160 to the bit-stream receiver 162 of the base station. On the other hand, when the VAD 152 detects no voice activity, the bit-stream transmitter 158 transmits no voice signal, although it may still transmit frames for comfort noise generation (CNG), such as described in U.S. Pat. No. 5,960,389, during such periods of inactivity so that the background noise at the receiver matches that at the transmitter.

The VAD 152 outputs an active signal, which indicates an inactive-to-active transition, both to the handset=s control interface 164 and the ADR 156, thereby signifying that voice frames are present. The handset=s control interface 164, in turn, informs the traffic channel manager 166 via the control channel 168 that a traffic channel is needed to send the bit-stream. The traffic channel manager 166, in turn, locates and allocates an available traffic channel and, after the access delay, Da, informs the handset=s control interface 164 by sending an appropriate message back over the control channel 168, which is sent on to the ADR 154. The traffic channel is requested and assigned by the traffic channel manager 166 at the start of each talkspurt. At the end of each talkspurt, the VAD 152 detects that no further speech is being generated, and sends an appropriate signal to the handset=s control interface 164 which, in turn, informs the traffic channel manager 166 that the assigned traffic channel is no longer needed and now may be reused.

When the ADR 154 receives the active signal from the VAD 152, it starts buffering the frames of speech in an internal buffer. And when the ADR 154 receives the signal from the control interface 164, it can determine the access delay Da. This can be done, for example, by use of a real time clock/timer associated with the communication device, or by measuring a >current position=pointer in the AIP 150 both upon receiving the active signal (>voice present=) from the VAD 152 and also upon receiving the second signal (>channel established=), and taking the difference. In general the particular manner in which the ADR obtains the channel delay is not critical, so long as it has access to this information.

In the present disclosure, the ADR 154 is configured to speed up the speech at the beginning of each utterance so as to make up for the access delay Da within some time period T. This is accomplished by compressing the speech by some speed-up rate r during the time period T. The speed-up rate r at which the access delay Da is mitigated is given by r=Da/T. It should be noted, however, that the speed-up rate r is a tunable parameter which may be selected, given latitude in adaptively determining T, upon ascertaining the delay access Da. Higher speed-up rates remove the access delay faster, but at the expense of noticeably more distorted output speech. Lower speed-up rates are less noticeable in the output speech, but take longer to remove the delay. In one embodiment, $0.08 \leqq r \leqq 0.15$, and in another embodiment, r 0.12, or 12%. Thus, in one embodiment, an access delay of Da=60 msec is mitigated in a time-scaling interval T=500 msec, near the beginning of each talkspurt. Should the utterance then continue, no further mitigation is required since the time-scale compression during the time period T would have accounted for the entire access delay. The output of the ADR 154 is sent to the speech encoder 156 in preparation for transmission by the bit-stream transmitter 158.

To maintain proper signal phase in voiced regions, only segments that are an integer number of estimated pitch periods are cut from the signal. In regions with long pitch periods where only a little bit needs to be removed, the cutting is deferred until the pitch period drops. Thus, it may take a little longer than a predetermined time-scaling interval T allotted for fully mitigating the access delay.

In one embodiment, the VAD 152 is external to the speech encoder 156, rather than being part of the speech encoder, as in conventional implementations. This is because the speech must be time-scaled before it is sent to the speech encoder 156, which requires that the output of the VAD be known before the encoder is called into play. Furthermore, while the ADR 154 could be integrated into an encoder, it is simpler to implement it as a preprocessor. This way, a single ADR implementation may be used with any speech encoder.

Figure 4:
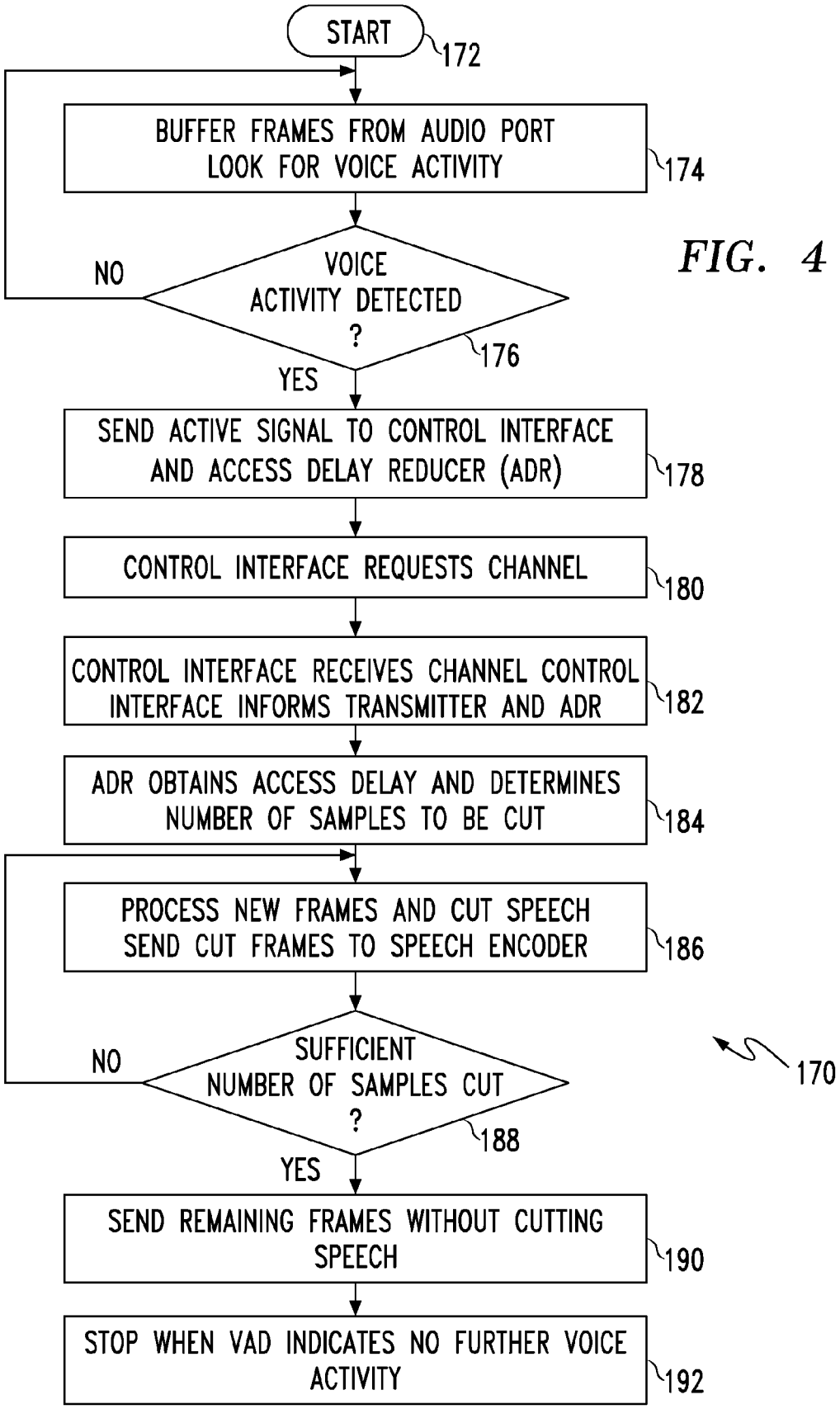
FIG. 4 shows a flow chart governing the operation of the communication device of FIG. 3.

FIG. 4 presents a generalized flow chart 170 of a method to operate the communication device of FIG. 3 in accordance with the present disclosure. In step 172, the communication device is turned on and the AIP 150 outputs frames of data, whether or not voice is present. In step 174, the VAD 152 and the ADR 154 both receive the frames output by the AIP, with the ADR 154 temporarily buffering the frames, just in case the VAD determines that voice activity was present. In step 176, the VAD 152 checks for voice activity. If no voice activity is detected, additional frames are taken in and buffered and checked. If voice activity is detected, in step 178, the VAD 152 sends an active signal to the control interface 164 and also to the ADR 154. In step 180, the control interface 164 requests a channel and in step 182, informs the ADR 154 and the bit-stream transmitter 158 that a channel has been allocated for the current talkspurt. In step 184, the ADR 154 obtains the access delay and determines the number of samples that it must cut from the talkspurt within the time period T. In step 186, the ADR 154 processes new frames from the AIP 150, cutting samples in accordance with a predetermined algorithm, and sends the cut frames onto to the speech encoder 156 in preparation for transmission. In step 188, the ADR 154 checks to see whether a sufficient number of samples have been cut. If not, control returns to step 176 to process and make cuts in additional frames. If, however, it is determined at step 188 that a sufficient number of samples have been cut, at step 190, the remaining frames are passed through to the encoder without further cutting until, at step 192, the VAD 152 indicates that no further voice activity is being received in that talkspurt.

After the talkspurt is over, an active-to-inactive transition occurs in the VAD 152 and the VAD 152 sends an inactive signal to the handset=s control interface 164. When the handset=s control interface 164 receives and processes the inactive signal, this ultimately results in the traffic channel 160 being freed for reuse by the base station 142. The handset=s control interface 164 then waits for another active signal from the VAD 152, in response to another talkspurt. However, if the talkspurt is very short, e.g., less than the time period T of 500 msec, the system may not have enough time to completely remove the access delay. In this case, the bitstream transmitter 158 informs the handset=s control interface 164 that there is still data to send, which may defer freeing the traffic channel 160 until all the encoded packets have been transmitted.

Figure 5:
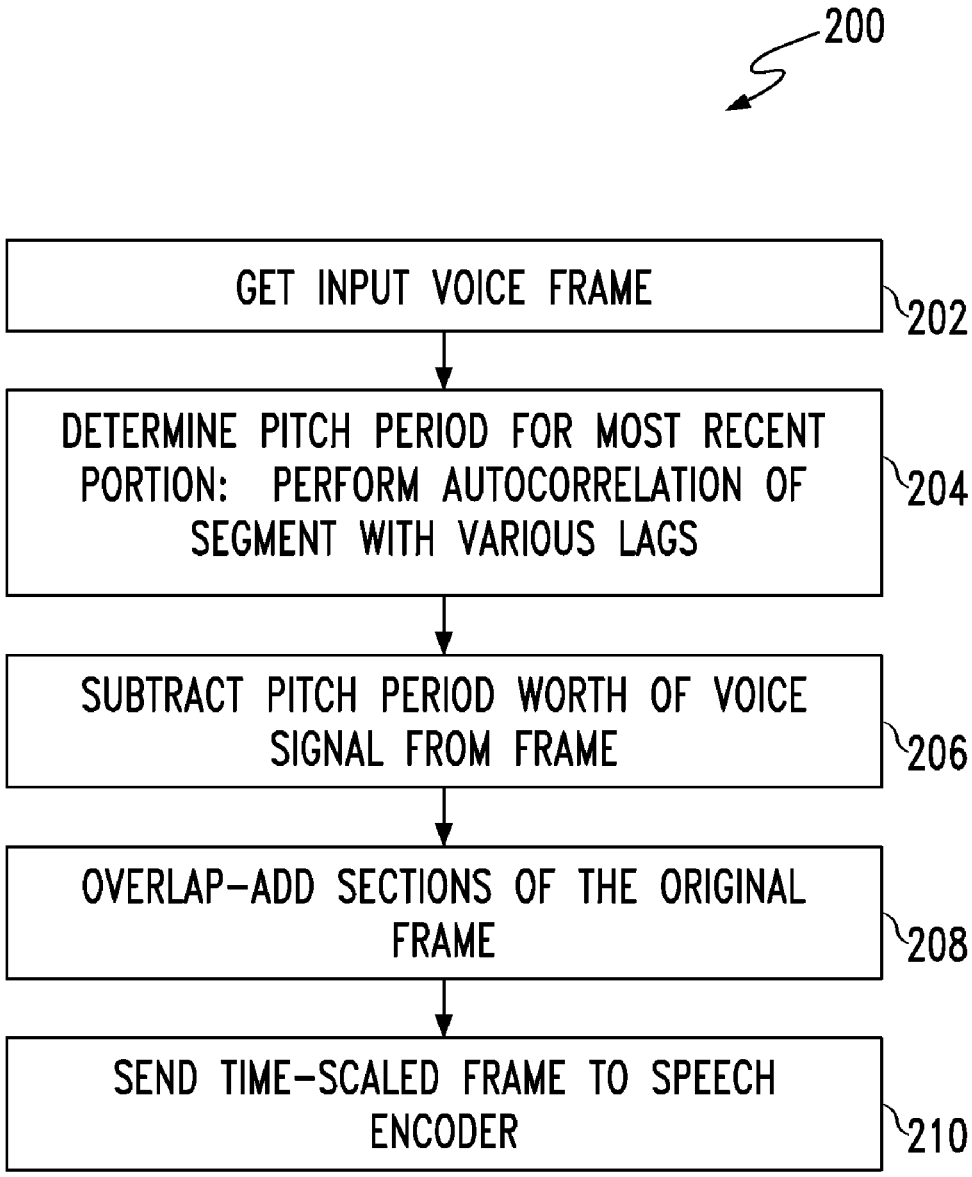
FIG. 5 shows a flow chart detailing the processing of a frame of voice data.

FIG. 5 presents a generalized flow chart 200, illustrating the steps associated with step 186 of FIG. 4. In step 202, the ADR 154 receives a frame from the AIP 150. In step 202, the ADR determines the pitch period P using the most recent portion of the received frame. In one embodiment, this is done by performing an autocorrelation of a terminal section of the frame, with earlier portions of that frame, and perhaps even earlier frames, by using various lags within some finite range. The lag corresponding to the peak of the resulting autocorrelation output is then taken as the pitch period P. The pitch period estimate P is used even when the speech is unvoiced. In step 206, the ADR subtracts one pitch period P worth of signal from the frame, although integer multiples of a single pitch period may be subtracted, if P is short enough. After the pitch period has been cut, a first segment of the frame located immediately before the cut portion, and a second segment of the frame comprising an endmost portion of the cut portion are merged. As seen in step 208, this is done by an overlap-add technique which mixes the two segments so as to ensure a smooth transition. Finally, in step 210, the cut frame is sent on to the speech encoder 156 in preparation for transmission of the cut frame.

It should be noted here that while the above description focuses on the access delay reducer being found in a handset, a similar functionality could also be found in a base station which must first establish/allocate a traffic channel before relaying a voice signal to the handset, and therefore must buffer and transmit the voice signal. In such case, access delay reduction may be employed in both directions.

The above-described disclosure is now illustrated through an example which uses human speech, and a simulated communications device. The simulation used a sampling rate of fs=8 kHz, a simulated access delay Da=60 msec, a time-scaling interval T=500 msec, with the speech being processed using a frame length F=20 msec.

Figure 6A:
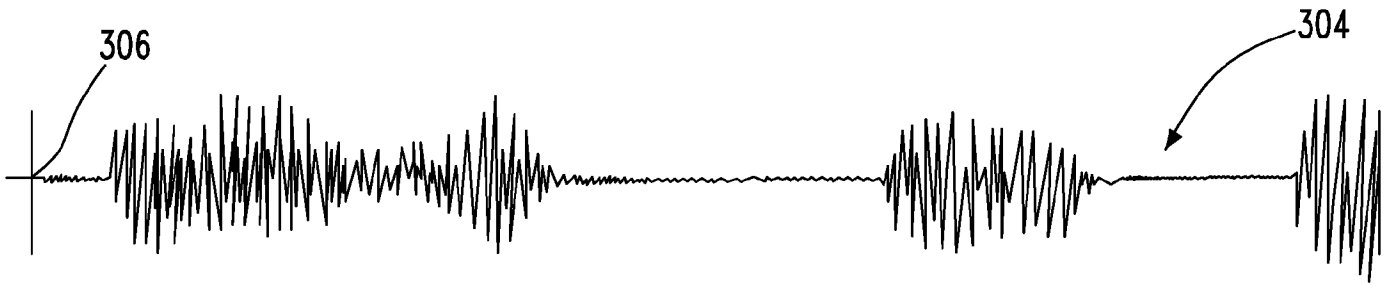
FIGS. 6*a* & 6*b* illustrate the effect of the present disclosure on a speech waveform.
Figure 6B:
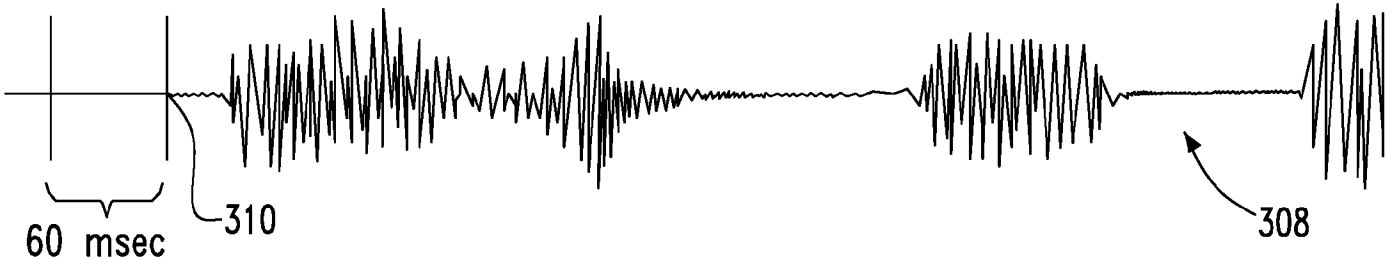

FIGS. 6*a* and 6*b*, present the speech waveforms illustrating the effect of the simulation. The input waveform 304 of FIG. 6*a* shows the unmodified first 750 msecs of a talkspurt input to an audio port. Mark 306 indicates the point at which the VAD 152 has detected an inactive-to-active transition and thus outputs the active signal. The region to the left of mark 306 has been zeroed out, since this signal is not transmitted. The output waveform of 308 of FIG. 6*b* shows the time-compressed output of an ADR delay algorithm which is fed into the speech encoder. The start of the talkspurt has been delayed by a simulated access delay of Da=60 msec. Mark 310 is placed on the output waveform 60 msec after mark 306. A speed-up rate of r=0.12, or 12%, is used so that the 60 msec simulated access delay is mitigated within the time-scaling interval T=500 msec. Thus, the input speech signal 304 is time-compressed for the 500 msec after mark 306 to remove the access delay, the result of the compression being shown after mark 310 in the output waveform 308. As seen in FIG. 6*b*, the time-compressed waveform has similar characteristics to the original input waveform, but is shorter by the 60 msec synthetic access delay. However, after the 500 msec catch-up period, the input and time-compressed waveforms are time-aligned.

In the present example, a general purpose VAD based on signal power, such as that described in U.S. Pat. No. 5,991,718, is used. The first few active speech frames from this VAD are placed in buffer associated with the ADR and, for various reasons, are not time-compressed, but rather are sent on to the speech encoder. When the transmission channel is granted, the obtained access delay Da is measured and converted to samples. At a sampling rate of 8 kHz, a simulated access delay Da=60 msecs corresponds to a total of 480 samples that must be removed over the time-scaling interval T=500 msec. This calls for a speed-up rate r=0.12=60 msec/500 msec. Since there are 25 frames of length F=20 msecs in a 500 msec time interval, on average, $^{480}/_{25}$=19.2 samples should be removed from each frame. To ensure that the cutting process is Aon track@, two accumulators are kept. One accumulator, called target count Tc, keeps track of how many samples should have been removed by the time the current frame is transmitted. Tc is initially 19.2 (since by the time the first frame is sent, about 19.2 samples should have been cut) and is incremented by 19.2 with each passing frame. The second accumulator, called the remaining count Rc, keeps track of how many more samples must be removed to get rid of the entire access delay. Therefore, in the present simulation, Rc is initially set to 480, and then decreases, each time samples are cut from a frame during the processing.

As discussed above, before subtracting any portion of the signal, a current pitch period was estimated. In the present example, this is performed by finding the lag corresponding to the peak of the normalized autocorrelation of the most recent Lc msecs of speech with varying lengths from Lmin to Lmax msecs=worth of immediately preceding speech, at step intervals of Lint. For the present example, Lc=20 msecs (160 samples at fs=8 kHz), Lmin=2.5 msec (20 samples at fs=8 kHz), Lmax=15 msec (120 samples at fs=8 kHz) and Lint=0.125 msec (1 sample at fs=8 kHz). Thus, the range of allowable pitch periods is established by Lmin and Lmax. To lower the computational complexity, however, the autocorrelation is performed in two stages: first a rough estimate is computed on a 2:1 decimated signal, and then a finer search is performed in the vicinity of the rough estimate with the undedicated signal.

Figure 7:
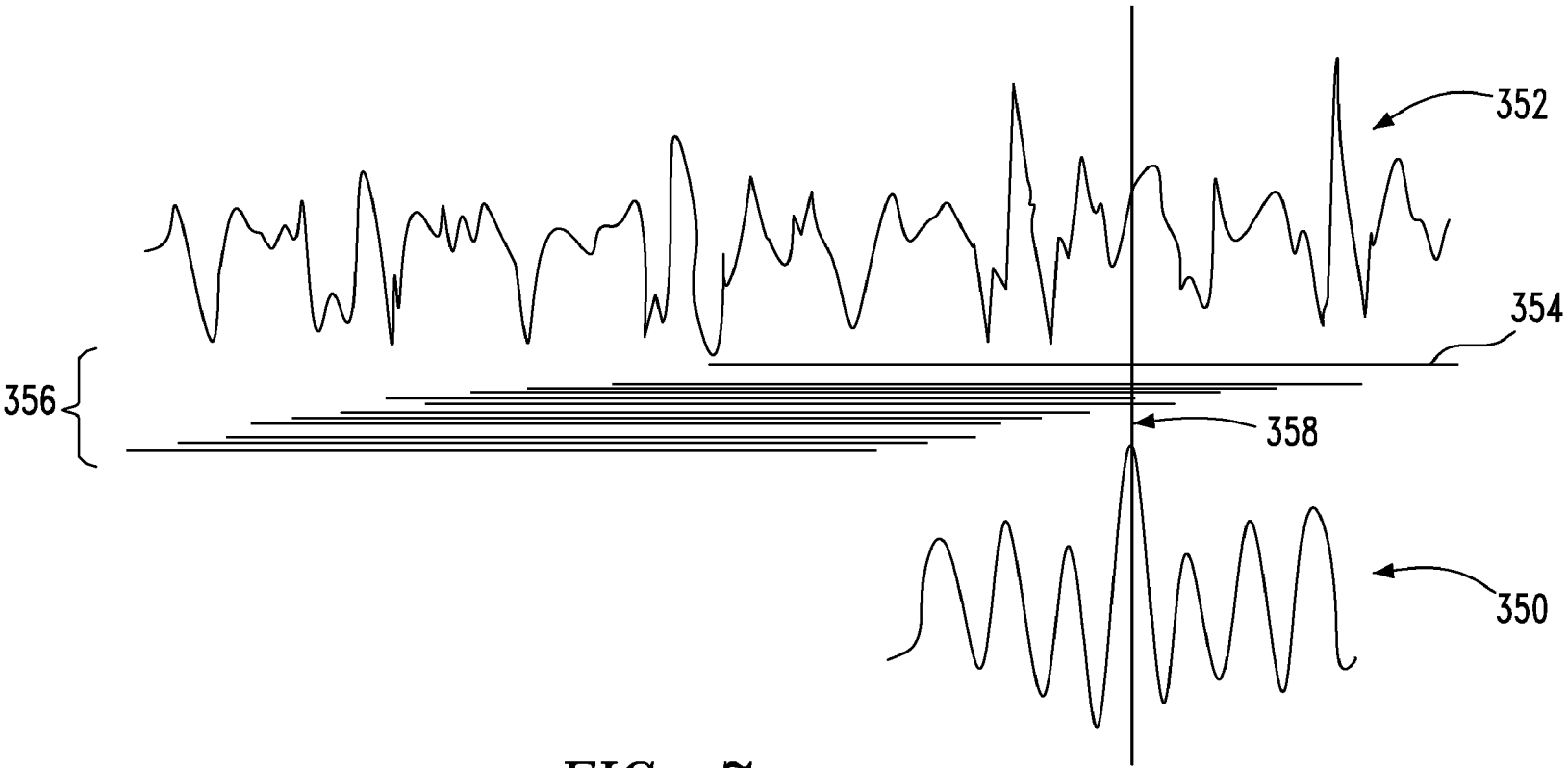
FIG. 7 illustrates the process for estimating the pitch period for a frame of voice data.

FIG. 7 illustrates the autocorrelation result 350 for pitch period estimation on a 35 msec portion 352 of the signal presented in FIG. 6*a*. A 20 msec-long reference 354 and a number of lag windows 356 for the autocorrelation are also shown. In FIG. 7 the autocorrelation result 350 is aligned with the tail end of the lag windows. The autocorrelation peak 358 corresponds to a pitch period estimate of P=8.875 msec (71 samples at 8 kHz) and is positioned one pitch period back from the end of the 35 msec portion 352. The calculated pitch period P, in samples, is compared to the current value of the target count Tc. If P>Tc, which may happen at the beginning of the talkspurt, no time-scaling is performed on the current frame and the next frame from the AIP is processed. If, however, P. Tc, a first portion of signal, having a length substantially equal to the pitch period P, can be removed from the input. This first portion is removed from the most recent part of the input signal.

Figure 8:
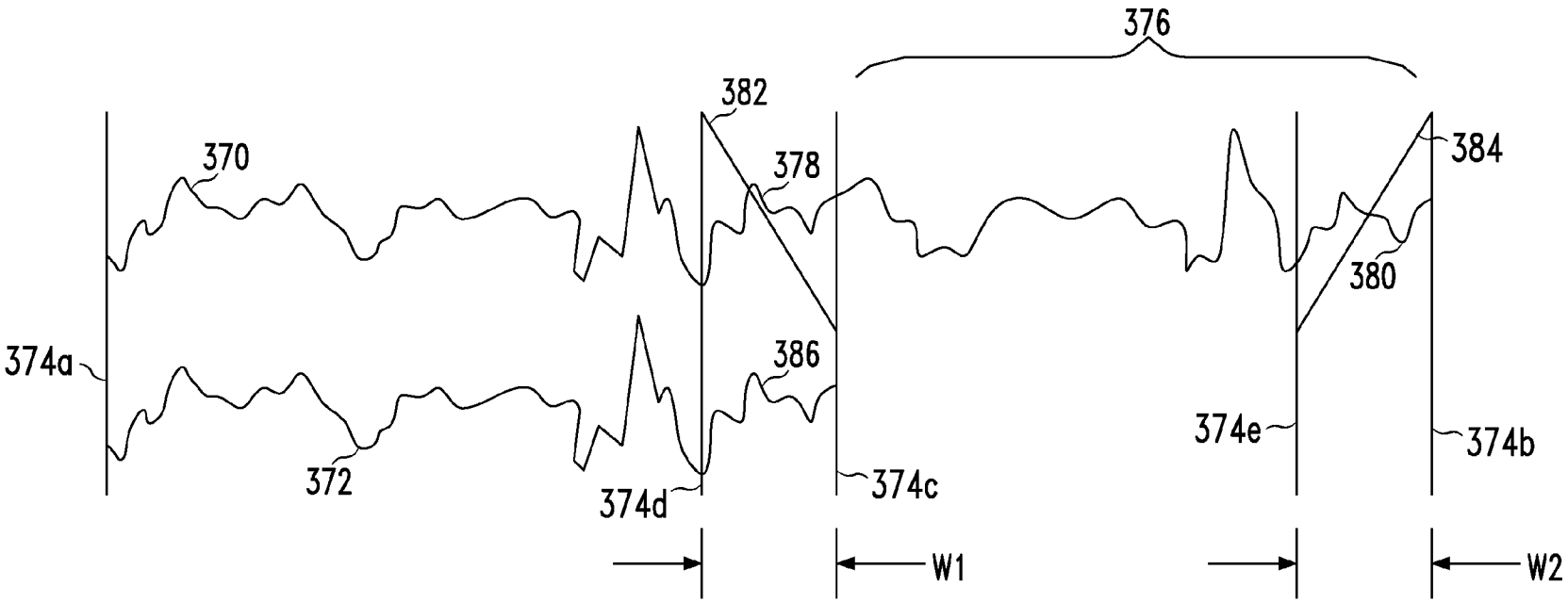
FIG. 8 shows an overlap-add method used in conjunction with removing a pitch period worth of data from frame of voice data.

FIG. 8 shows an overlap-add (OLA) pitch cutting operation for a portion of a speech signal sampled at a sampling rate of 8 kHz. The top waveform shows an original input frame 370 and the lower waveform shows the time-scaled frame 372 after removal of a pitch period and the OLA operation. The input frame 370 has a length 160 samples, or 20 msecs, and extends between demarcation lines 374*a*, 374*b*, which designate the beginning and the end of the input frame 30, respectively. The time-scaled frame 372 extends between demarcation lines 374*a* and 374*c*, and extends for 20 msec minus the length of the removed pitch period. For input frame 370, the pitch period is 71 samples, or 8.875 msecs, and so the time-scaled frame is 89 samples, or 11.125 msecs. As seen in FIG. 8, the 71-sample removed portion 376 of the input frame extends between demarcation lines 374*c* and 37*b*, at the end of input frame.

The OLA operation combines a first segment 378 of the original input frame having a length W1, which, in one embodiment, is ¼ of a pitch period, with a second segment 380 of the original input frame, also of length W1 using windows 382 and 384, respectively. The first segment 378 belongs to a section of the pitch period immediately preceding the removed portion 376, and the second segment 380 comes from the endmost portion of the removed portion 376 at the terminal section of the frame. The two segments 378, 380 are combined by multiplying by their respective windows and adding the result, to thereby form a smooth, mixed portion 386 of length W1, which forms the terminal part of the time-scaled frame 372. Thus, the forward portion of the time-scaled frame 372, seen extending between demarcation lines 374*a* and 374*d*, is an unmodified copy of the original input frame 370, while the terminal part of the time-scaled frame is a modified copy of a first section of the original input frame delimited by demarcation lines 374*d* and 374*c*, mixed with a copy of a second section of the original input frame delimited by demarcation lines 374*e* and 374*b*. The foregoing OLA thus results in a time-scaled frame which is formed entirely from the original input frame, and therefore does not rely on signal from an adjacent, or other, frame.

In the present implementation, the window length W1 is ¼ of the pitch period. It should be kept in mind, however, that other window lengths may also be used. Also, as seen in FIG. 8, the windows are triangular in shape. However, other window shapes may be used instead, so long as the mixture of the two windows is appropriately scaled. Regardless of the shape or length of the window, the OLA helps ensure a smooth transition at the terminal end of the time-scaled frame.

After the OLA operation, the time-scaled frame is placed in an output buffer whose contents are subsequently passed to the speech encoder 156. After the pitch period is removed, the target count Tc is decremented by the pitch period (in samples) and the remaining count Rc is decremented by the pitch period. The ADR continues time-scale compression on additional input frames until the access delay is removed, e.g., until Rc is below the minimum allowed pitch period. For the rest of the talkspurt, the input frames are handled directly to the speech encoder. At the end of the time-scaling interval there may still be some residual delay. The maximum value of this residual delay is determined by the minimum allowable pitch period, which is Lmax of 20 samples, or 2.5 msec. On average, then, the residual delay is about half this amount, about 10 samples, or about 1.125 msec, which is reasonable for most systems. If required, the residual delay may be removed during an unvoiced segment of speech, where phase errors are not as noticeable. This, however, would increase the complexity of the implementation.

Additional short cuts are taken to lower the complexity of the implementation. For example, since a pitch period will never be removed from a frame if Tc<Lmin, no pitch estimate is calculated if Tc<20. Also, if the pitch period is low, it may be possible to remove two complete pitch periods from a single 20 msec frame, and this is allowed if Tc is more than twice the estimated pitch period. Furthermore, in the implementation, sample removal is always performed at the end of the most recent 20 msec frame.

The computational complexity of the implementation described above is dominated by the autocorrelation. The autocorrelation and overlap-add operations require a maximum of 5027 MACs, 108 compares, 55 divides, and 54 squarroot operators per iteration. Assuming MACs take one cycle, compares take 2 and divides and square-roots take 10 cycles, this yields total of 6333 cycles. The autocorrelation and OLA can be called once a frame. Thus, with a 20 msec frame size, this leads to a complexity estimate of approximately 0.3 MIP. The VAD is estimated to add another 0.1 MIP for a total of 0.45 MIP. Decreasing the frame size to 10 msec would increase the possible frequency of autocorrelations and OLAs by a factor to 2, leading to a total estimate of 0.8 MIP for 10 msec frames. Changing the degree of overlap, too, would also affect the computational complexity.

Attached as Appendix 1 is sample c++ source code for a floating-point implementation of an access delay reduction algorithm.

While the above description is principally directed to wireless applications, such as cellular telephones, it should be kept in mind that time-scale compression of speech has applications in other settings, as well. In general, the principles of the present disclosure find use in any type of voice communication system in which statistical multiplexing of channels is performed. Thus, for example, the present disclosure may be of use in Digital Circuit Multiplication Equipment and also in Packet Circuit Multiplication Equipment, both of which are used to share voice channels in long distance cables, such as undersea cables.

And while the above disclosure has been described with reference to certain embodiments, it should be kept in mind that the scope of the present disclosure is not limited to these. One skilled in the art may find variations of these embodiments which, nevertheless, fall within the spirit of the present disclosure, whose scope is defined by the claims set forth below.

What is claimed is:

1. A system for operating a communications network, the system comprising:

a processor;

a module configured to control the processor to buffer frames of a signal;

a module configured to control the processor to determine an access delay of a channel request for the signal;

a module configured to control the processor to compress a portion of the signal based on the access delay by performing the steps:

removing a first portion of a frame of the signal; and generating an overlap-added segment from a first segment of the frame located before the first portion and a second segment of the frame comprising an endmost portion of a terminal section of the frame.

2. The system of claim 1, further comprising a discontinuous transmission packet telephony network having the access delay.

3. The system of claim 1, further comprising a module configured to control the processor to form a time-scaled frame, and wherein the first portion comprises an integer number of a pitch period's worth of the signal.

4. The system of claim 3, wherein the module is further configured to control the processor to form the overlap-added segment at an end portion of the time-scaled frame.

5. The system of claim 1, wherein the signal is a voice signal.

6. The system of claim 1, further comprising a module configured to control the processor to remove the first portion from a terminal section of the frame.

7. The system of claim 1, wherein the module configured to control the processor to compress a portion of the signal based on the access delay is an access delay reducer.

8. The system of claim 1, wherein the module configured to control the processor to compress a portion of the signal based on the access delay is further configured to control the processor to generate the overlap-added segment by multiplying the first segment and the second segment by a window, and adding the products of the multiplication together.

9. The system of claim 1, wherein the module configured to control the processor to compress a portion of the signal based on the access delay is further configured to remove the first portion of the frame even if the first portion comprises unvoiced speech.

10. A system for operating a communications network, the system comprising:

a processor;

a module configured to control the processor to receive a signal and remove a first portion of a frame of the signal; and a module configured to control a processor to generate an overlap-added segment from a first segment of the frame located before the first portion and a second segment of the frame comprising an endmost portion of a terminal section of the frame.

11. The system of claim 10, wherein the module configured to control the processor to receive a signal and remove a first portion of a frame of the signal, and the module configured to control the processor to generate an overlap-added segment together form an access delay reducer.

12. The system of claim 10, wherein the module configured to control the processor to receive a signal and remove a first portion of a frame of the signal, and the module configured to control the processor to generate an overlap-added segment are configured to operate in a discontinuous transmission packet telephony network having a channel access delay.

13. The system of claim 10, further comprising a module configured to control the processor to form a time-scaled frame, and wherein the first portion comprises an integer number of a pitch period's worth of the signal.

14. The system of claim 13, wherein the module is further configured to control the processor to form the overlap-added segment at an end portion of the time-scaled frame.

15. The system of claim 10, wherein the signal is a voice signal.

16. The system of claim 10, further comprising a module configured to control the processor to remove the first portion from a terminal section of the frame.

17. The system of claim 10, wherein the module configured to control the processor to generate an overlap-added segment is further configured to generate an overlap-added segment by multiplying each of the first segment and the second segment by a window and adding together the products of the multiplication.

18. The system of claim 10, wherein the module configured to control the processor to receive a signal and remove a first portion of the signal is further configured to remove the first portion from the frame even if the first portion comprises unvoiced speech.

19. A base station comprising:

a processor;

a module configured to control the processor to buffer frames of a signal of a channel request for the signal;

a module configured to control the processor to establish a communication channel with a handset;

a module configured to control the processor to determine an access delay;

a module configured to control the processor to compress a portion of the signal based on the access delay by performing the steps:

removing a first portion of a frame of the signal; and generating an overlap-added segment from a first segment of the frame located before the first portion and a second segment of the frame comprising an endmost portion of a terminal section of the frame.

20. The base station of claim 19, further comprising a module configured to control the processor to transmit the signal to the handset.

* * * * *